US006691340B2

(12) United States Patent
Honda et al.

(10) Patent No.: US 6,691,340 B2
(45) Date of Patent: Feb. 17, 2004

(54) AUTOMATIC FAUCET

(75) Inventors: Tadahiro Honda, Kitakyushu (JP); Takatoshi Kawabata, Kitakyushu (JP); Hitoshi Nakao, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 0 days.

(21) Appl. No.: 10/146,931

(22) Filed: May 17, 2002

(65) Prior Publication Data

US 2003/0213062 A1 Nov. 20, 2003

(51) Int. Cl.[7] ..... E03C 1/05
(52) U.S. Cl. ..... 4/623; 4/675; 4/678
(58) Field of Search ..... 4/623, 675–678

(56) References Cited

U.S. PATENT DOCUMENTS

| | | | | | |
|---|---|---|---|---|---|
| 4,894,874 | A | * | 1/1990 | Wilson | 4/623 |
| 4,955,535 | A | * | 9/1990 | Tsutsui et al. | 4/623 |
| 5,504,950 | A | * | 4/1996 | Natalizia et al. | 4/623 |
| 5,555,912 | A | * | 9/1996 | Saadi et al. | 4/623 |
| 5,984,262 | A | * | 11/1999 | Parsons et al. | 4/623 |

FOREIGN PATENT DOCUMENTS

| | | | | |
|---|---|---|---|---|
| DE | 3135861 A1 | * | 3/1983 | E03C/1/04 |
| JP | 2-93369 | | 7/1990 | |
| JP | D1109504 | | 5/2001 | |
| JP | 2002-7096 A | | 3/2002 | |

OTHER PUBLICATIONS

Copies of English Translation of Jap. Des. App. D1109504, Jap. Laid Open Pub. P2002–7096A and Jap. Utility Model Laid–Open Pub. No. 2–93369.

* cited by examiner

*Primary Examiner*—Tuan N. Nguyen
(74) *Attorney, Agent, or Firm*—Michael D. Bednarek; Shaw Pittman LLP

(57) ABSTRACT

An automatic faucet has a closing valve, a controller of the closing valve, a discharging member connected to the closing valve through a pipe, an optical sensor connected to the controller through an electric wire and a cylindrical faucet body through which the conduit and the electric wire are passed. The discharging member and the optical sensor are directed in the same direction, assembled in a unit, and installed in a single space formed in the front end portion of the faucet body.

7 Claims, 6 Drawing Sheets

AUTOMATIC FAUCET

BACKGROUND OF THE INVENTION

The present invention relates to an automatic faucet wherein a closing valve operates under signals from a sensor for detecting a human body and a discharging member disposed at the front end portion of a water passage extending downstream of the closing valve discharges water.

An automatic faucet provided with a discharging member and an optical sensor disposed close to and directed in the same direction as the discharging member is disclosed in Japanese Utility-Model Laid-Open Publication No.2-93369. In this automatic faucet, the optical sensor projects light in parallel with the stream line of the discharging water and detects the hands of a user, wherever the hands are put into the stream line of the discharging water, and the water starts to discharge. The automatic faucet is therefore convenient. In the automatic faucet, a pair of spaces are formed in the front end portion of a cylindrical faucet body. The discharging member is installed in one of the spaces and the optical sensor is installed in the other of the spaces. Therefore, the automatic faucet has a disadvantage that the front end portion of the faucet has a complex structure that makes assembly of the faucet difficult, production cost of the faucet high, and maintenance of the faucet troublesome.

SUMMARY OF THE INVENTION

The object of the present invention is to provide an automatic faucet that is convenient for the user, easy to assemble, producible at low cost and easy to maintain.

In accordance with the present invention, there is provided an automatic faucet comprising a closing valve, a controller of the closing valve, a discharging member connected to the closing valve through a pipe, an optical sensor connected to the controller through an electric wire and a cylindrical faucet body through which the pipe and the electric wire are passed, wherein the discharging member and the optical sensor are directed in the same direction, assembled in a unit, and installed in a single space formed in the front end portion of the faucet body.

The discharging member and the optical sensor are directed in the same direction. Therefore, wherever a user puts his or her hands into the stream line of the discharging water, the optical sensor projecting light in parallel with the stream line of the discharging water detects the hands and the water starts to discharge. The automatic faucet of the present invention is therefore convenient. The discharging member and the optical sensor are assembled in a unit and installed in a single space formed in the front end portion of the faucet body. Thus, the front end portion of the automatic faucet of the present invention has a simple structure. Therefore, the automatic faucet of the present invention is easy to assemble, producible at low cost, and easy to maintain.

In accordance with a preferred embodiment of the present invention, the discharging member and the optical sensor are assembled to be detachable.

The discharging member and the optical sensor assembled to be detachable can be detached from each other and maintained independently. Therefore, maintenance of the automatic faucet becomes easy. Moreover, they can be exchanged independently. Therefore, the cost of maintaining the automatic faucet can be reduced.

In accordance with a preferred embodiment of the present invention, the optical sensor surrounds the discharging member.

The optical sensor surrounding the discharging member can fill an annular space formed between the discharging member and the peripheral circumferential surface of the single space in the front end portion of the faucet body. Therefore, cleaning of the front end portion of the automatic faucet becomes easy.

In accordance with a preferred embodiment of the present invention, the discharging member is fixed to the faucet body with a screw upwardly threaded into the discharging member.

The screw can be easily disengaged. Therefore, the discharging member and the optical sensor assembled in a unit can be easily detached from the faucet body and maintenance of the automatic faucet becomes easy. The head of the screw upwardly threaded into the discharging member is shield from the view of the user. Therefore, the automatic faucet is more appealing during operation.

In accordance with a preferred embodiment of the present invention, the discharging member is screwed into the faucet body to be fixed to the faucet body.

Connection by screwing can be easily released. Therefore, the discharging member and the optical sensor assembled in a unit can be easily detached from the faucet body and maintenance of the automatic faucet becomes easy.

In accordance with a preferred embodiment of the present invention, the discharging member is provided with key grooves.

Connection of the discharging member with the faucet body by screwing can be easily released by rotating a tool engaging the key grooves. Therefore, the discharging member and the optical sensor assembled in a unit can be easily detached from the faucet body and maintenance of the automatic faucet becomes easy.

In accordance with a preferred embodiment of the present invention, the discharging member is provided with slits at its front end.

The discharging member can be compressed in the radial direction as the slits become narrow. Thus, an annular space between the discharging member and the peripheral circumferential surface of the single space in the front end portion of the faucet body is enlarged, which makes the work of detaching the discharging member from the faucet body easy. Therefore, maintenance of the automatic faucet becomes easy.

DETAILED DESCRIPTION OF THE PREFERRED EMBODIMENTS

A first preferred embodiment of the present invention will be described in detail.

Figure 1:
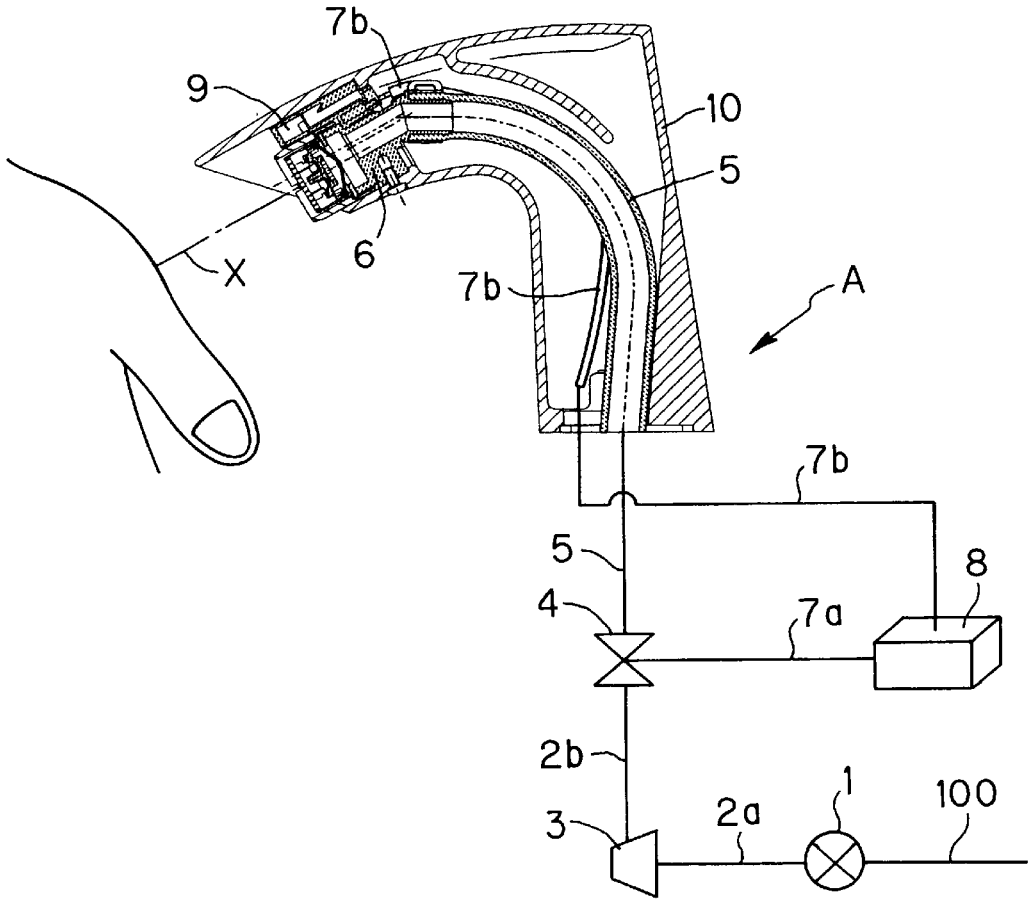
FIG. 1 is a structural diagram of an automatic faucet in accordance with a first preferred embodiment of the present invention.

As shown in FIG. 1, an automatic faucet A is provided with a stop cock 1 installed in a water supply line 100, a constant flow valve 3 connected to the stop cock 1 through a pipe 2*a*, a closing valve 4 connected to the constant flow valve 3 through a pipe 2*b*, a discharging member 6 connected to the closing valve 4 through a pipe 5, a controller 8 connected to the closing valve 4 through an electric wire 7*a*, a reflective infrared-ray sensor 9 connected to the controller 8 through an electric wire 7*b*, and a curved cast faucet body 10 through which the pipe 5 and the electric wire 7*b* are passed The faucet body 10 stands on the upper surface of a wash basin not shown in Figures.

Figure 2:
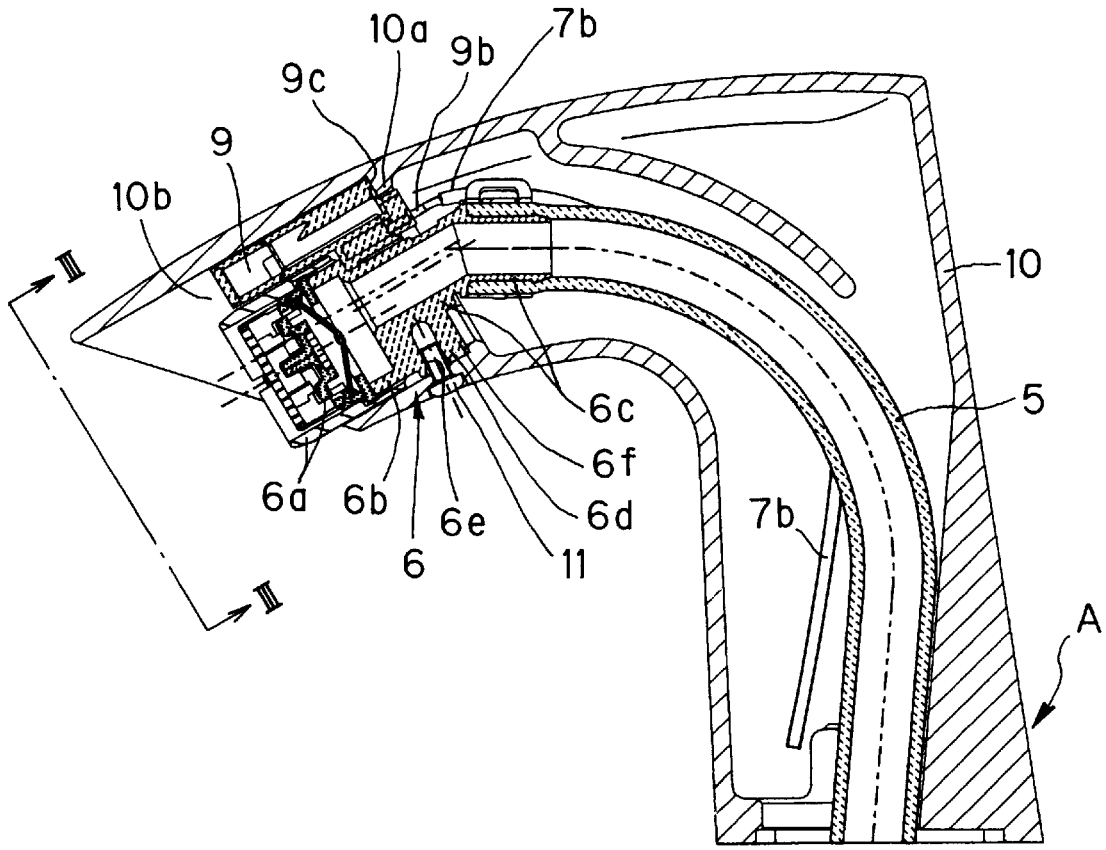
FIG. 2 is a sectional view of an automatic faucet in accordance with the first preferred embodiment of the present invention.
Figure 3:
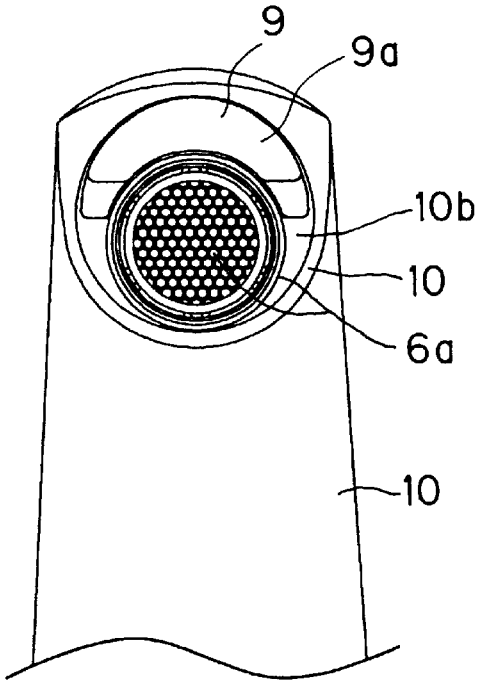
FIG. 3 is a view in the direction of arrows III—III in FIG. 2.
Figure 4A:
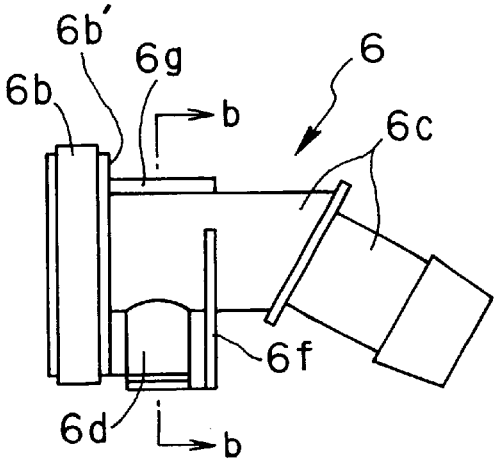
FIG. 4 is a set of structural views of a discharging member provided for the automatic faucet in accordance with the first preferred embodiment of the present invention. (a) is a side view and (b) is a view in the direction of arrows b—b in (a).
Figure 4B:
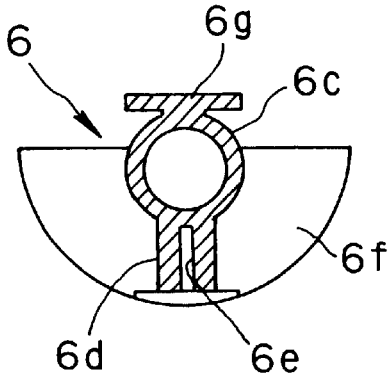

As shown in FIGS. 2 to 4, the discharging member 6 has a bubble flow discharging member 6*a*, a large diameter cylinder 6*b* on which the bubble flow discharging member 6*a* is screwed, a small diameter cylinder 6*c* extending from the larger diameter cylinder 6*b*. A column 6*d* extends from the small diameter cylinder 6*c* outwardly in the radial direction. The column 6*d* is provided with a female screw 6*e*. The small diameter cylinder 6*c* is provided with a semicircular flange 6*f* extending outwardly in the radial direction. The flange 6*f* is close to the column 6*d*. The small diameter cylinder 6*c* is provided with an engaging member 6*g* at its portion close to the large diameter cylinder 6*b*. The engaging member 6*g* contacts and extends in parallel with the small diameter cylinder 6*c*. The small diameter cylinder 6*c* is connected to the pipe 5. The joint between the small diameter cylinder 6*c* and the pipe 5 is sealed.

Figure 5A:
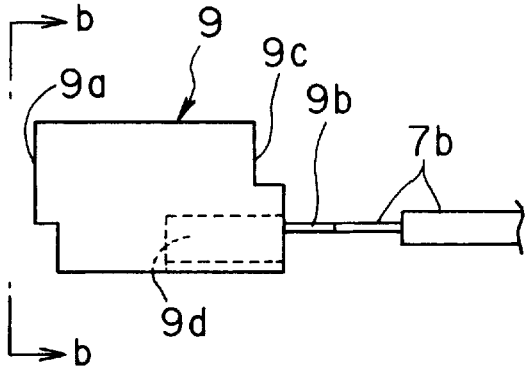
FIG. 5 is a set of structural views of an infrared-ray sensor provided for the automatic faucet in accordance with the first preferred embodiment of the present invention. (a) is a side view and (b) is a view in the direction of arrows b—b in (a).
Figure 5B:
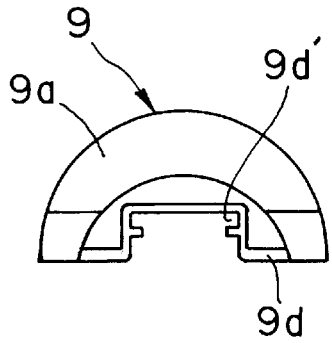

As shown in FIGS. 2, 3 and 5, the reflective infrared-ray sensor 9 is column-shaped with crescent-shaped cross section. The front end of the infrared-ray sensor 9 defines a projecting and receiving surface 9*a*. A connecting terminal 9*b* extends from the rear end of the infrared-ray sensor 9. The connecting terminal 9*b* is connected to the electric wire 7*b*. The joint between the connecting terminal 9*b* and the electric wire 7*b* is sealed. The infrared-ray sensor 9 is provided with a step 9*c* at a portion close to its rear end. An engaging member 9*d* is fixed to the inner circumferential surface of the infrared-ray sensor 9. The engaging member 9*d* is provided with a pair of grooves 9*d*' in face to face opposition. Opposite sides of the engaging member 6*g* can be passed through the pair of grooves 9*d*'.

Figure 6A:
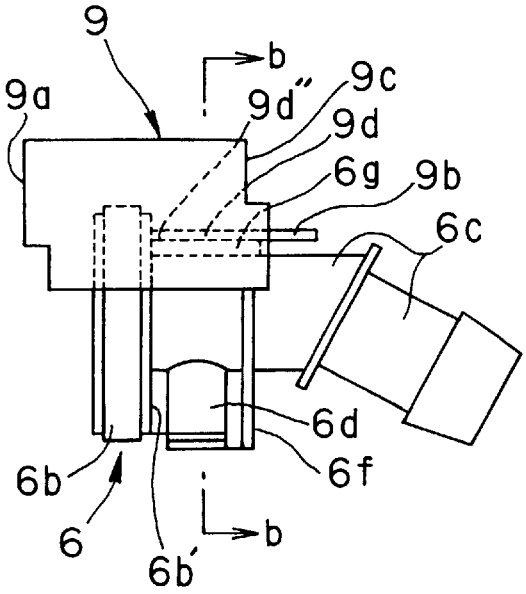
FIG. 6 is a set of structural views of a discharging member and an infrared-ray sensor assembled in a unit provided for the automatic faucet in accordance with the first preferred embodiment of the present invention. (a) is a side view and (b) is a view in the direction of arrows b—b in (a).
Figure 6B:
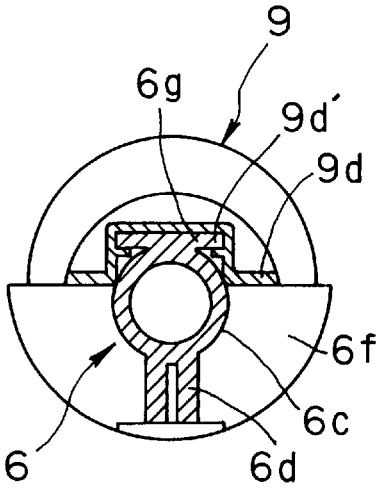

As shown in FIGS. 2, 3 and 6, the discharging member 6 and the infrared-ray sensor 9 are assembled in a unit to be detachable. The engaging member 6*g* engages the engaging member 9*d* with the opposite sides of the engaging member 6*g* passed through the pair of grooves 9*d*'. The front end 9*d*" of the engaging member 9*d* abuts the rear end 6*b*' of the large diameter cylinder 6*b*. As can be seen in FIGS. 2 and 3, the infrared-ray sensor 9 assembled with the discharging member 6 in a unit surrounds upper half portions of the bubble flow discharging member 6*a*, the large diameter cylinder 6*b* and the small diameter cylinder 6*c*, and the projecting and receiving surface 9*a* is directed in the same direction as the bubble flow discharging member 6*a* and the large diameter cylinder 6*b* of the discharging member 6.

The faucet body 10 is provided with an annular projection 10*a* on the inner circumferential surface of a portion close to the front end and slanting downward. A portion of the faucet body 10 extending between the annular projection 10*a* and the front end defines a single space 10*b* for receiving the discharging member 6 and the infrared-ray sensor 9. The discharging member 6 and the infrared-ray sensor 9 assembled in a unit are installed in the single space 10*b*. The step 9*c* of the infrared-ray sensor 9 and the external flange 6*f* of the discharging member 6 abut the annular projection 10*a* of the faucet body 10. The discharging member 6 is fixed to the front end portion of the faucet body 10 with a screw 11 threaded upwardly into the female screw 6*e*. The infrared-ray sensor 9 is fixed to the faucet body 10 with the front end 9*d*" of the engaging member 9*d* abutting the rear end 6*b*' of the large diameter cylinder 6*b* and the step 9*c* abutting the annular projection 10*a*.

Operation of the automatic faucet A will be described in detail.

When a user puts his or her hands into a stream line X of the water discharging from the automatic faucet A, the hands are detected by the infrared-ray sensor 9 and a detection signal is inputted to the controller 8. The controller 8 sends a control signal to the closing valve 4 to open it. City water supplied through the water supply line 100 passes through the stop cock 1 which is normally open. The flow rate of the water is controlled to a predetermined value by the constant flow valve 3. The water passes through the opened close valve 4 and flows into the discharging member 6 through the pipe 5. When the water passes through the bubble flow discharging member 6*a*, many micro air bubbles disperse into the water. The water containing the many dispersed micro air bubbles discharges as a bubble flow from the automatic faucet A. When the user removes his or her hands from the stream line X of the discharging water, the detection signal from the infrared-ray sensor 9 stops. The controller 8 sends a control signal to the closing valve 4 to close it, thereby stopping the discharge of the water from the automatic faucet A.

In the automatic faucet A, the projecting and receiving surface 9*a* of the infrared-ray sensor 9 is directed in the same direction as the bubble flow discharging member 6*a* and the large diameter cylinder 6*b* of the discharging member 6. Therefore, wherever the user puts his or her hands into the stream line X of the discharging water, the infrared-ray sensor 9 projecting infrared-rays in parallel with the stream line X of the discharging water detects the hands and the water starts to discharge. The automatic faucet A is therefore convenient. The discharging member 6 and the infrared-ray sensor 9 assembled in a unit are installed in a single space defined in the front end portion of the faucet body 10. Thus, the front end portion of the automatic faucet A has a simple structure. Therefore, the automatic faucet A is easy to assemble, producible at low cost, and easy to maintain.

The discharging member 6 and the infrared-ray sensor 9 can be detached from each other and maintained independently because they are assembled to be detachable. Therefore, the automatic faucet A is easy to maintain. The discharging member 6 and the infrared-ray sensor 9 can be exchanged independently. Therefore, the cost of maintaining the automatic faucet A can be reduced.

As can be seen in FIG. 3, an annular space formed between the discharging member 6 and the peripheral circumferential surface of the single space 10*b* defined in the front end portion of the faucet body 10 is filled with the infrared-ray sensor 9 surrounding the bubble flow discharging member 6*a*, the large diameter cylinder 6*b* and the small diameter cylinder 6*c* of the discharging member 6. Therefore, cleaning of the front end portion of the automatic faucet A is easy.

The discharging member 6 and the infrared-ray sensor 9 assembled in a unit can be easily detached from the faucet body 10 because the discharging member 6 is fixed to the front end portion of the faucet body 10 with the screw 11 which can be easily disengaged. Therefore, the automatic faucet A can be maintained easily. The head of the screw 11 is shield from the view of the user because the screw 11 is upwardly threaded into the discharging member 6. Therefore, the automatic faucet A has strong appeal during operation.

An automatic faucet in accordance with a second preferred embodiment of the present invention will be described in detail.

Figure 7:
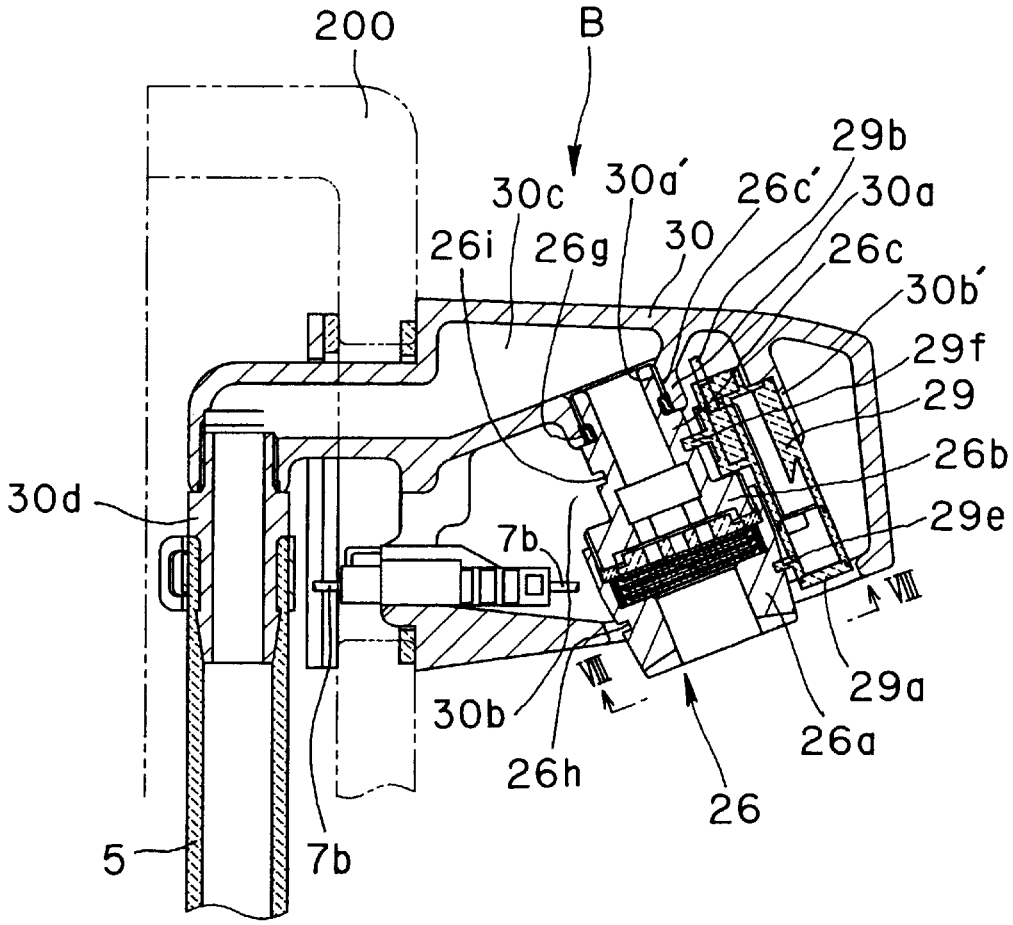
FIG. 7 is a sectional view of an automatic faucet in accordance with a second preferred embodiment of the present invention.

As shown in FIG. 7, a cast faucet body 30 of an automatic faucet B is mounted on the side surface of a wash basin 200. A single space 30*b* defined in the front end portion of the faucet body 30 slants downward. The faucet body 30 is provided with a passage 30*c* communicating the single space 30*b*. An annular projection 30*a* defines a communicating passage between the passage 30*c* and the single space 30*b*. The annular projection 30*a* is provided with a female screw 30*a*'. A connecting pipe 30*d* is screwed on the upstream end of the passage 30*c*. The connecting pipe 30*d* connects to the pipe 5 extending from the closing valve 4. A column-shaped infrared-ray sensor 9 with crescent-shaped cross section is provided with engaging projections 29*e* and 29*f* at its inner circumferential surface. A bubble flow discharging member 26*a* and a small diameter cylinder 26*c* of a discharging member 26 are provided with circumferential grooves 26*h* and 26*i* at their outer circumferential surfaces. The small diameter cylinder 26*c* is provided with a male screw 26*c*' at its one end. The engaging projections 29*e* and 29*f* engage the circumferential grooves 26*h* and 26*i*. Thus, the discharging member 26 and the infrared-ray sensor 29 are assembled in a unit. The infrared-ray sensor 29 assembled with the discharging member 26 in a unit surrounds the upper half potions of the bubble flow discharging member 26*a*, a large diameter cylinder 26*b* and the small diameter cylinder 26*c*. A projecting and receiving surface 29*a* of the infrared-ray sensor 29 is directed in the same direction as the bubble flow discharging member 26*a* and the large diameter cylinder 26*b* of the discharging member 26.

The discharging member 26 and the infrared-ray sensor 29 assembled in a unit are installed in the single space 30*b*. The discharging member 26 is fixed to the front end portion of the faucet body 30 with the male screw 26*c*' threaded into the female screw 30*a*'. The infrared-ray sensor 29 is clamped by the large diameter cylinder 26*b* and a step formed in the faucet body 30 to be fixed to the faucet body 30. The discharging member 26 is rotated to thread the male screw 26*c*' into the female screw 30*a*'. When the discharging member 26 is rotated, the infrared-ray sensor 29 with crescent-shaped cross section abuts a peripheral circumferential surface 30*b*' of the single space 30*b* to be kept from rotation. On the other hand, the engaging projections 29*e* and 29*f* rotate relatively to the discharging member 26 along the circumferential grooves 26*h* and 26*i*. Thus, the discharging member 26 can be rotated without difficulty. The joint between the male screw 26*c*' and the female screw 30*a*' is sealed by an O-ring 26*g*. The electric wire 7*b* extending from the controller 8 is led into the faucet body 30 through the side wall of the wash basin 200 and connected to a connecting terminal 29*b* of the infrared-ray sensor 29. The joint between the electric wire 7*b* and the connecting terminal 29*b* is sealed.

The automatic faucet B operates in the same way as the automatic faucet A. Connection by screwing can be easily released. Therefore, the discharging member 26 and the infrared-ray sensor 29 assembled in a unit can be easily detached from the faucet body 30. Therefore, the automatic faucet B can be maintained easily.

Figure 8:
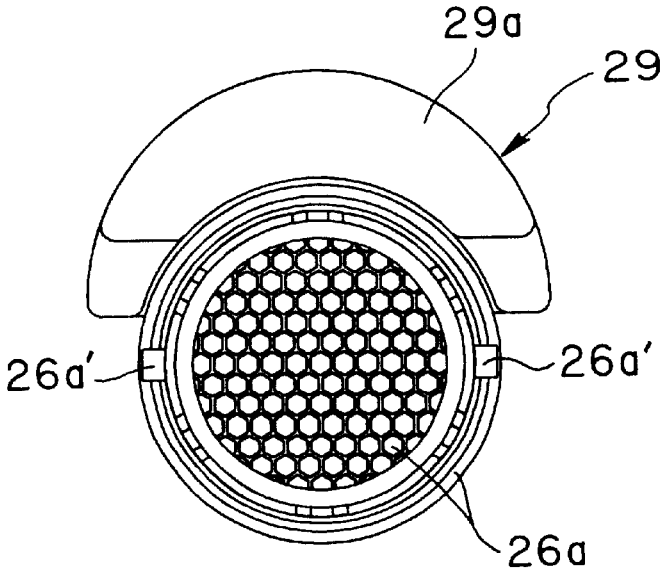
FIG. 8 is a view in the direction of arrows VIII—VIII in FIG. 7.

As shown in FIG. 8, the bubble flow discharging member 26*a* may be provided with two or more key grooves 26*a*'.

The discharging member 26 can be easily screwed on or unscrewed from the faucet body 30 by rotating a tool engaging the key grooves 26*a*'. Thus, maintenance of the automatic faucet B becomes easy.

Figure 9:
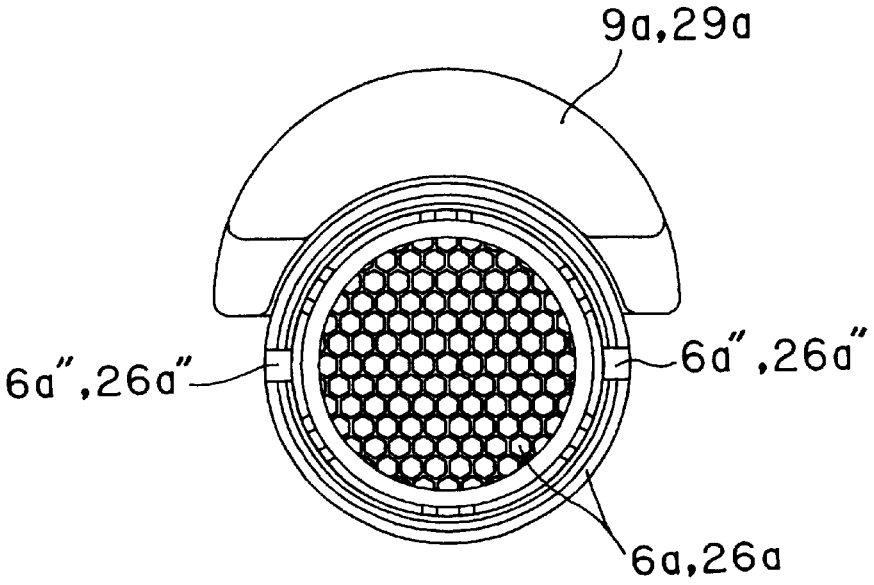
FIG. 9 is a view corresponding to FIG. 8 of an automatic faucet in accordance with another preferred embodiment of the present invention.

As shown in FIG. 9, the bubble flow discharging members 6*a* and 26*a* my be provided with two or more slits 6*a*" and 26*a*" at their front ends.

The bubble flow discharging members 6*a*, 26*a* can be compressed in the radial direction to narrow the slits 6*a*", 26*a*". Thus, an annular space between the bubble flow discharging members 6*a*, 26*a* and the peripheral circumferential resurfaces of the single spaces 10*b*, 30*b* is enlarged, operations for detaching the discharging members 6, 26 from the faucet bodies 10, 30 become easy, and maintenance of the automatic faucets A, B become easy.

The faucet body 10, 30 may be made of pipes. The cost of producing the automatic faucets A, B can be reduced.

The infrared-ray sensors 9, 29 may surround the discharging members 6, 26 beyond their upper half portions. On the other hand, the infrared-ray sensors 9, 29 need not necessarily surround the discharging members 6, 26.

The automatic faucet in accordance with the present invention can be widely used as a plumbing device for public use as well as a plumbing device for domestic use.

While the present invention has been described with reference to preferred embodiments, one of ordinary skill in the art will recognize that modifications and improvements may be made while remaining within the spirit and scope of the present invention. The scope of the invention is determined solely by the attached claims.

What is claimed is:

1. An automatic faucet, comprising:

a closing valve;

a controller of the closing valve;

a discharging member connected to the closing valve through a pipe;

an optical sensor connected to the controller through an electric wire; and a cylindrical faucet body through which the pipe and the electric wire are passed, wherein the discharging member and the optical sensor are directed in the same direction and installed in a single space formed in the front end portion of the faucet body, the discharging member is fixed to the faucet body, and the optical sensor is clamped by a projection provided for the faucet body and the discharging member to be fixed to the faucet body.

2. An automatic faucet of claim 1, wherein the discharging member and the optical sensor are assembled in a unit to be detachable.

3. An automatic faucet of claim 1, wherein an annular space formed between the discharging member and the peripheral circumferential surface of the single space formed in the front end portion of the faucet body is partially filled with the optical sensor.

4. An automatic faucet of claim 1, wherein the discharging member is fixed to the faucet body with a screw upwardly threaded into the discharging member.

5. An automatic faucet of claim 1, wherein the discharging member is screwed into the faucet body to be fixed to the faucet body.

6. An automatic faucet of claim 5, wherein the discharging member is provided with key grooves to engage a tool for rotating the discharging member, thereby screwing the discharging member on or unscrewing the discharging member from the faucet body.

7. An automatic faucet of claim 5, wherein the discharging member is provided with slits at its front end for enabling compression of the discharging member in the radial direction and enlargement of an annular space between the discharging member and the peripheral circumferential surface of the single space, thereby easing operations for detaching the discharging member from the faucet body.

* * * * *